US009295332B2

(12) United States Patent
Barile et al.

(10) Patent No.: US 9,295,332 B2
(45) Date of Patent: Mar. 29, 2016

(54) FLEXIBLE BACK CHAIR WITH SPRING CAN ASSEMBLY

(71) Applicant: Daniel Paul Chairs, LLC., Morristown, TN (US)

(72) Inventors: Peter W Barile, Morristown, TN (US); Michael E. Saylor, Morristown, TN (US)

(73) Assignee: Daniel Paul Chairs, LLC, Morristown, TN (US)

( * ) Notice: Subject to any disclaimer, the term of this patent is extended or adjusted under 35 U.S.C. 154(b) by 84 days.

(21) Appl. No.: 14/181,901

(22) Filed: Feb. 17, 2014

(65) Prior Publication Data

US 2015/0230615 A1 Aug. 20, 2015

(51) Int. Cl.
*A47C 3/04* (2006.01)
*A47C 7/44* (2006.01)
*A47C 7/02* (2006.01)

(52) U.S. Cl.
CPC . *A47C 7/443* (2013.01); *A47C 3/04* (2013.01); *A47C 7/021* (2013.01)

(58) Field of Classification Search
CPC ..... A47C 7/443; A47C 3/04
USPC ..... 297/292, 293, 299, 300.5, 362.13, 297/301.4
See application file for complete search history.

(56) References Cited

U.S. PATENT DOCUMENTS 2,587,822 A 3/1952 Corning
2,981,319 A 4/1961 Close
3,603,640 A * 9/1971 Doerner ..... 297/292
4,004,836 A * 1/1977 Kristensson ..... 297/362.13
5,039,163 A 8/1991 Tolleson
5,100,201 A 3/1992 Becker, III et al.
5,452,937 A * 9/1995 Piretti ..... 297/301.4
5,704,688 A 1/1998 Schrewe et al.
5,902,012 A 5/1999 Han
5,904,397 A 5/1999 Fismen
5,988,746 A 11/1999 Raftery
5,997,084 A 12/1999 Barile, Jr. et al.
6,406,096 B1 6/2002 Barile, Sr.
6,471,293 B2 10/2002 Ware et al.
6,533,352 B1 * 3/2003 Glass et al. ..... 297/299
6,561,961 B2 * 5/2003 Wu ..... 482/148
6,679,551 B2 1/2004 Ware et al.
6,715,834 B1 * 4/2004 Liao ..... 297/362.13
6,820,934 B2 11/2004 Ware et al.
6,896,327 B1 5/2005 Barile, Sr.
7,008,015 B2 * 3/2006 Bischoff ..... 297/216.1
7,021,712 B2 4/2006 Spendlove et al.
7,249,801 B2 * 7/2007 Tonin ..... 297/300.5
8,388,064 B2 3/2013 Bertolini et al.
8,646,839 B2 * 2/2014 Moreschi ..... 297/300.5

(Continued)

*Primary Examiner* — David R Dunn
*Assistant Examiner* — Timothy J Brindley
(74) *Attorney, Agent, or Firm* — Pitts & Lake, P.C.

(57) ABSTRACT

Disclosed is a chair containing a flexible back support frame mechanism that includes an improved spring assembly designed to allow reclining movement of a back support frame relative to a seat assembly. The spring can assembly of the present invention is, preferably, carried by a rear cross support member thereby eliminating the need for cumbersome elongated springs and their attendant support members. Further, the spring can assembly of the present invention allows the compression member to be readily and easily changed, thus providing the ability to easily adjust the flex tension of the back support member.

19 Claims, 7 Drawing Sheets

(56) References Cited

U.S. PATENT DOCUMENTS

| | | | | |
|---|---|---|---|---|
| 2004/0026972 | A1 | 2/2004 | Spendlove | |
| 2005/0161990 | A1* | 7/2005 | Piretti | 297/285 |
| 2007/0069565 | A1* | 3/2007 | Diffrient | 297/300.5 |
| 2007/0278837 | A1* | 12/2007 | White et al. | 297/362.13 |
| 2010/0096894 | A1* | 4/2010 | Fukai | 297/300.5 |
| 2010/0244522 | A1* | 9/2010 | Fukai | 297/300.3 |
| 2012/0274111 | A1* | 11/2012 | Piretti | 297/301.4 |
| 2013/0099534 | A1 | 4/2013 | Barile, Jr. et al. | |

* cited by examiner

FLEXIBLE BACK CHAIR WITH SPRING CAN ASSEMBLY

CROSS-REFERENCE TO RELATED APPLICATIONS

Not Applicable.

STATEMENT REGARDING FEDERALLY-SPONSORED RESEARCH OR DEVELOPMENT

Not Applicable.

BACKGROUND OF THE INVENTION

1. Field of Invention

The present invention relates generally to the field of seating and chairs including moveable and stackable seating. More specifically, this invention relates to stackable chairs having a flexible back support with an improved spring assembly.

2. Description of the Related Art

Prior chairs having a flexible backrest frame have provided frame members with spring members connected internal of seat tube members for control of movement of the backrest frame of the chair. A typical flexible backrest is illustrated in U.S. Pat. No. 5,039,163, issued to Tolleson, which discloses a chair including depending leg members and a hollow support frame having members with open ends terminating beneath the seat assembly of the chair. The chair includes a pair of hollow backrest frame members having open frame ends extending beneath the seat assembly for alignment with respective open ends of the support frame members. Each open end of the respective frame members includes at least one flexible spring member inserted therein. Prior configurations of spring members allow insertion of opposed spring member ends into opposed and aligned open frame ends, with each spring member being aligned with the frame ends and extended to fill any gap between the respective back frame members and support frame members. Therefore, replacement of the spring member required full disassembly of the chair frame and removal of each inserted spring member end. In order to prevent each spring element from excessive flexing during reclining movements of the chair backrest, the spring member ends have been typically enclosed by pairs of U-shaped brackets of metal that limit the range of angular movement of each enclosed spring member, thereby limiting the reclining movements of the chair backrest. Additional pairs of spring members and U-shaped brackets have been required to be added for rigorous use. The additional pairs of spring members are typically positioned parallel to each first set of spring members with associated enclosure by U-shaped brackets of greater width or depth, thereby requiring an increased width or depth of the support frame members to accommodate the additional spring members and brackets.

Another example of a prior art chair having a flexible backrest frame is illustrated in U.S. Pat. No. 6,896,327, issued to Barile, which discloses a stackable chair with a seat assembly and flexible back support having a seat spring system attached there between. The seat assembly includes seat sides having spaced apart rear portions. The back support includes lower ends curved forwardly and disposed in registry with and separated by right and left gaps from respective seat side rear portions. Right and left spring members are disposed inwardly adjacent to bridge each gap. Each spring member includes forward ends connected to respective right and left front support members extended inbound from respective seat sides, and includes rear ends connected to opposed ends of a frame rear cross-member. The spring members allow limited reclining movement of the back frame. A limit to excessive forward movement of the back support is provided by pairs of fixation plates positioned in aligned and abutting relationship on upper surfaces of each respective forward and rear ends of each spring member.

The prior art leaf springs are securely fastened to the frame of the chair making replacement of the spring difficult and labor intensive. What is missing from the art is a stackable chair with a flexible back support frame employing a spring assembly attached directly to the rear cross support member of the seat assembly that allows for easily replacing the spring, or compression, member allowing for ease of adjustment of flex tension, thus eliminating elongated, or leaf, spring members and their attendant support members.

BRIEF SUMMARY OF THE INVENTION

The present invention provides an improved spring assembly for a chair frame for a stackable chair having a flexible back member. While described herein in terms of a stackable chair, it will be appreciated that the present invention has utility with non-stackable chairs as well. The chair frame comprises a seat support portion for supporting a chair seat, and a pair of leg assemblies oppositely disposed on either side of the seat support portion. Each leg assembly includes a front leg and a rear leg, and an upper support member. Each leg assembly also includes a stacking bar extending between the front leg and the rear leg, the stacking bar being disposed below, and being selectively spaced from the upper support member. The stacking bar of each leg assembly has a lower surface configured to closely engage at least a portion of the upper surface of the upper support member of another chair frame of the present invention to facilitate the stacking of the chair frame on such other chair frame.

The back support frame includes frame lower ends curved forwardly and positioned in registry with and spaced apart by a gap separation from the rear portions of the seat assembly. Right and left spring can assemblies are carried by the rear cross support member. This improved spring can assembly dispenses with the need for the prior art elongated springs and their attendant support components that were previously required.

During reclining movement of the back support frame, the back support frame member compresses the compression member downwardly to a compressed position. When reclining pressure is released from the back support frame member, the spring member biases the back support frame member to a non-reclined position, thereby returning the back support to a substantially upright position when not reclined by a seat occupant.

BRIEF DESCRIPTION OF THE DRAWINGS

The above-mentioned and additional features of the invention will become more clearly understood from the following detailed description of the invention read together with the drawings in which:

FIG. 3 illustrates an exploded view of the plunger, compression member, and plunger of the present invention.

FIG. 4A is an assembled perspective view; while FIG. 4B is an exploded perspective view.

DETAILED DESCRIPTION OF THE INVENTION

Figure 1:
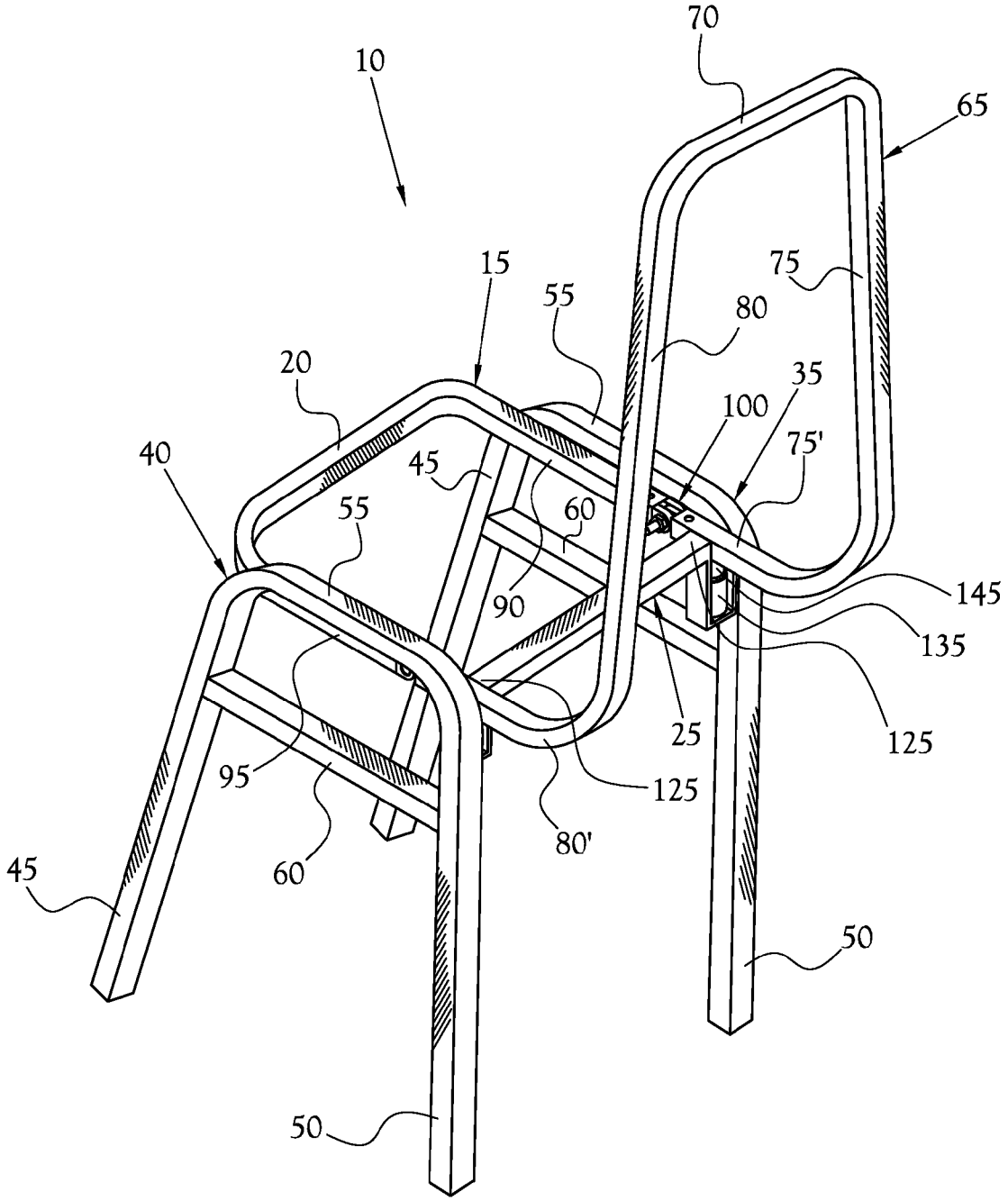
FIG. 1 illustrates a perspective view of a chair constructed in accordance with the present invention.
Figure 2A:
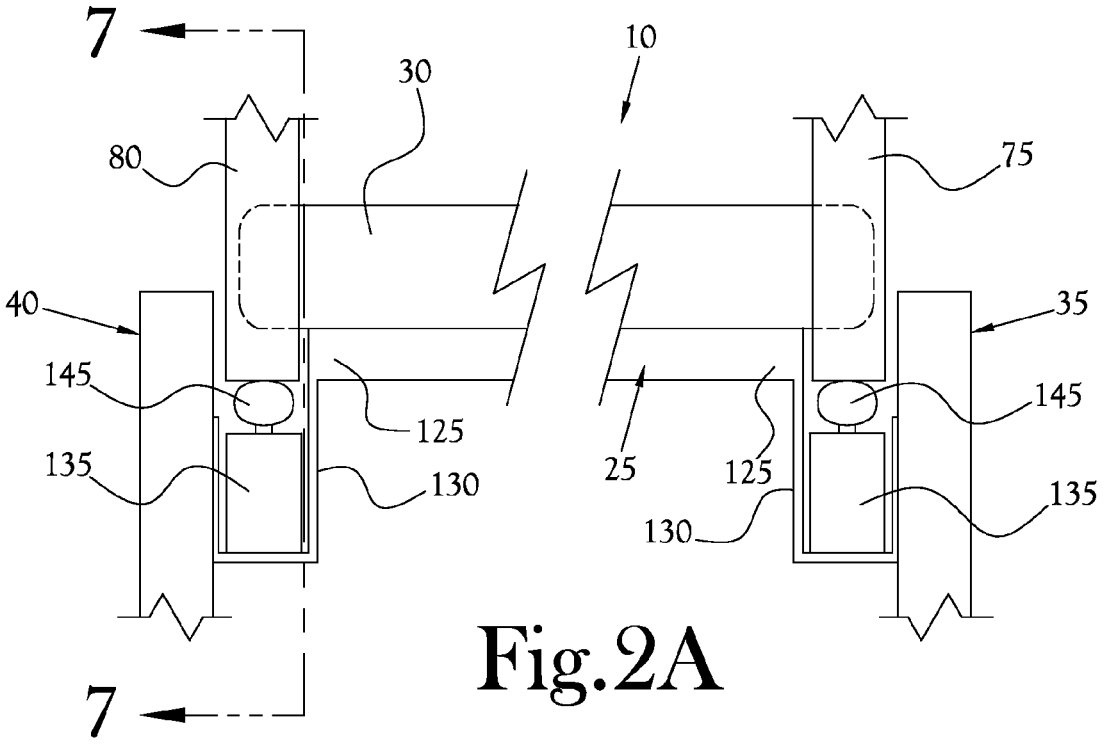
FIGS. 2A and 2B illustrate a partial rear elevation view of the chair illustrated in FIG. 1.
Figure 2B:
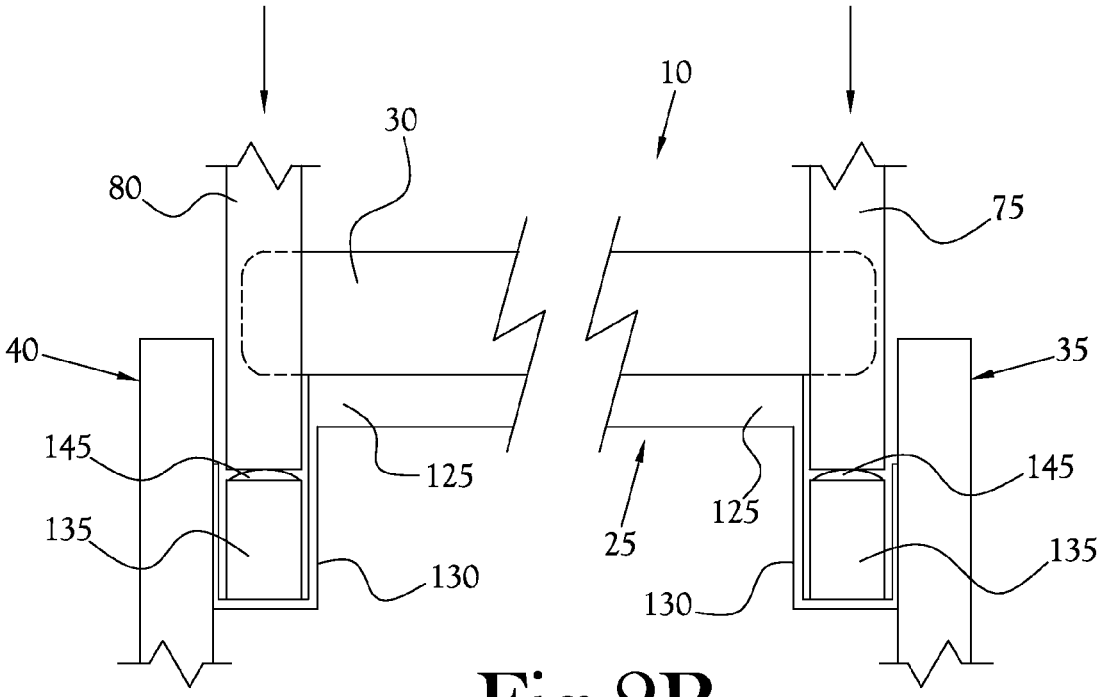

A chair frame for a stackable chair incorporating various features of the present invention is illustrated generally at 10 in FIGS. 1-7. While the chair frames 10, constructed in accordance with the present invention may be stacked, one upon another, to facilitate the storage of a plurality of chairs, it will be appreciated that the present invention is not limited to stackable chairs but rather could be utilized with non-stacking chairs or other seating structures, such as benches, that include a back support frame.

The chair frame 10 includes a seat support portion 15 which in the preferred illustrated embodiment defines a generally U-shaped frame portion 20 and a rear cross support member 25 which extends across, and is secured at its opposite ends to, the right and left leg assemblies 35, 40. The seat support portion 15 is used to support the seat portion of a chair utilizing the frame 10, such as the seat cushion 30.

The right and left leg assemblies 35 and 40 are disposed on opposite sides of, and attached to, the seat support portion 15. Each of the leg assemblies 35 and 40 includes a front leg 45 and a rear leg 50. The leg assemblies 35 and 40 also include an upper support member 55 which is disposed between the upper ends of the front leg 45 and the rear leg 50. As will be understood by those skilled in the art, the upper support members 55 serve to support another chair utilizing a chair frame 10 which is stacked above. In the preferred embodiment, the support members 55 extend between, and serve to support, the associated leg members 45 and 50. Each of the leg assemblies 35 and 40 are also provided with a stacking bar 60 which extends between the front leg 45 and the rear leg 50, and which is selectively spaced below the upper support member 55.

In the preferred embodiment the chair frame 10 also includes a back support frame member 65 for supporting a seat back member (not shown), which can be a cushion or a rigid member for supporting the back of an occupant of the chair. The back support frame member 65 includes an upper portion 70 joined at opposed ends to right and left frame side members 75 and 80 which are spaced apart by a sufficient width to accept a seat back member (not shown). Each frame side member 75 and 80 extends downwardly and is bent forwardly to form respective frame lower ends 75', 80' that extend forwardly to a generally horizontal orientation in aligned registry with and spaced apart from the seat member rear portions 90 and 95. In order to facilitate the preferred hinged attachment of the frame lower ends 75', and 80' with the seat member rear portions 90 and 95, a gap is preferably provided there between.

Figure 4A:
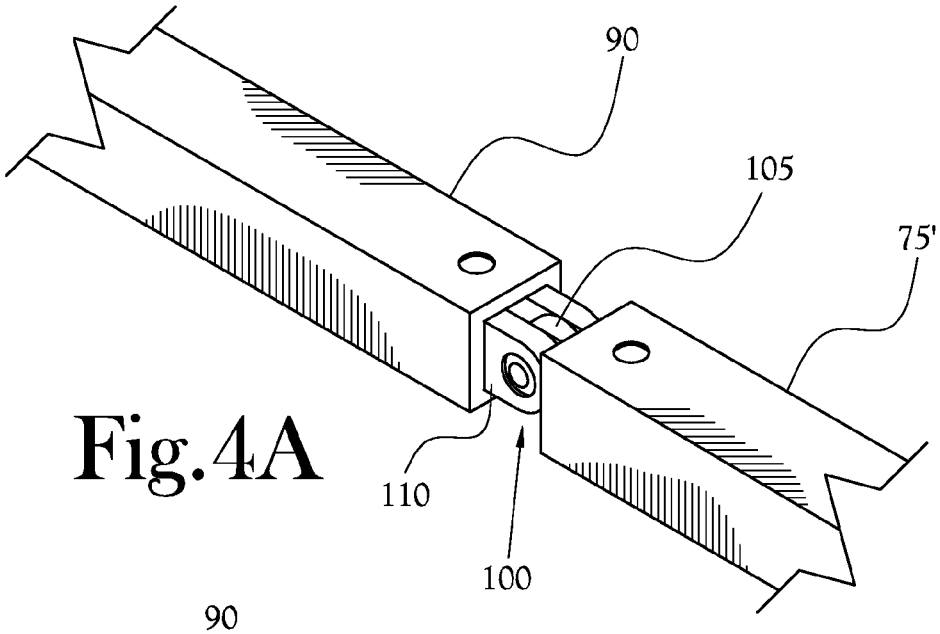
FIGS. 4A and 4B illustrates the hinge member of the present invention.
Figure 4B:
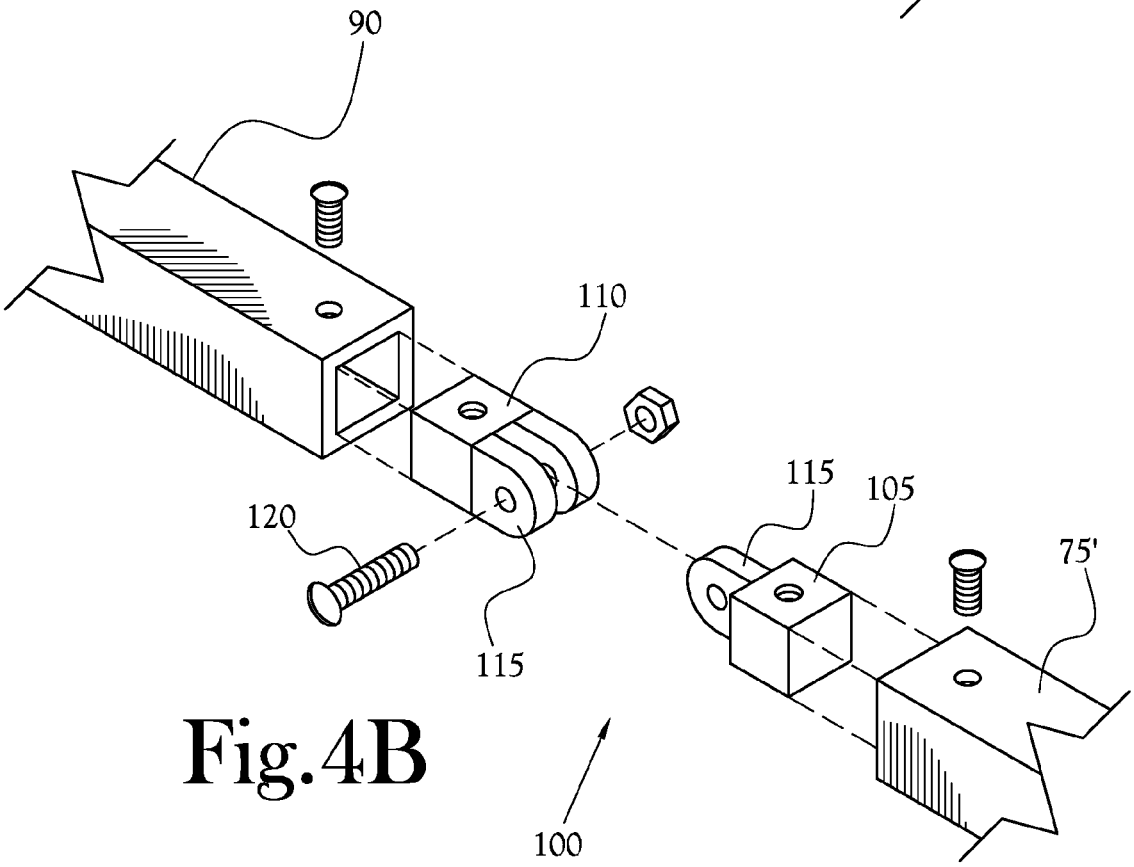
Figure 5:
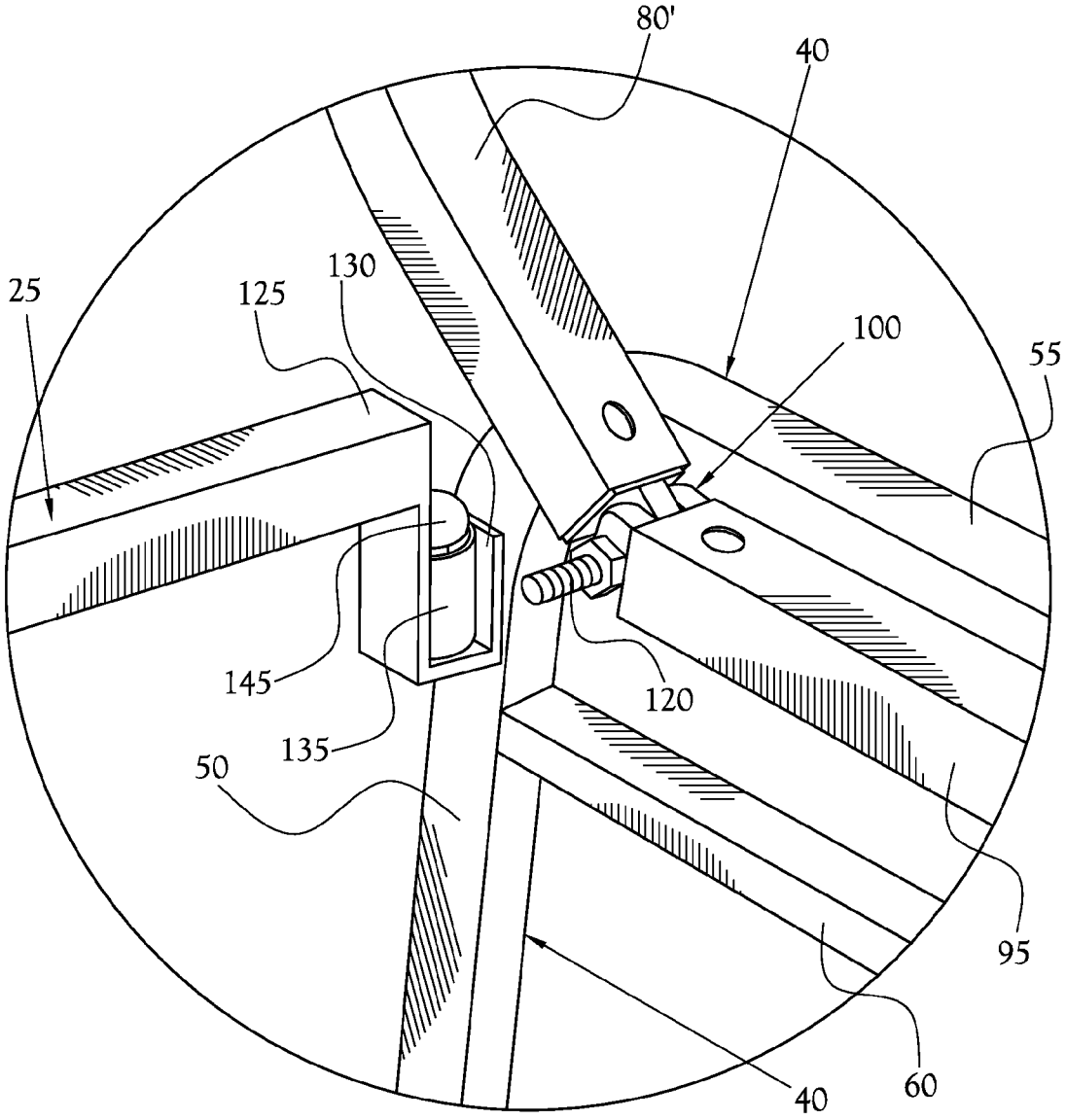
FIG. 5 is a partial perspective view of the chair illustrated in FIG. 1.

As best illustrated in FIGS. 4A and 4B, the chair frame 10 includes hinge assembly 100 defined by cooperating hinge members 105 and 110 for connecting the lower ends 75' and 80' of the back support frame member 65 to the rear portions 90 and 95 of the seat assembly 15 respectively. In the preferred embodiment, each hinge member 105 and 110 includes at least one knuckle 115 which are connected hingedly by a pin 120. In one embodiment, hinge member 105 defines a tenon which is releasably received by the tubular end of either of the lower ends 75' and 80', in mortise and tenon manner. Similarly, hinge member 110 defines a tenon which is releasably received by the tubular end of the rear portions 90 and 95 of the seat assembly 15. Whereas the figures, specifically FIGS. 4A and 4B depict a tenon and mortise configuration for the knuckles 115 of the hinge members 105 and 110, it will be appreciated by those skilled in the art, that the hinge members 105 could include a plurality of knuckles for receiving hinge pin 120. It will be appreciated that the present invention does not intend to limit the number or configuration of the knuckles of hinge assembly 100. Rather, it should be appreciated that, regardless of the configuration and number of knuckles of the hinge assembly 100, hinge assembly 100 is configured so as to provide pivotal motion of the lower ends 75' and 80' with respect to rear portions 90 and 95. Further, while one type of hinge member has been shown, those skilled in the art will appreciate that various types of hinge members could be utilized. Further, it will be recognized that frame lower ends 75' and 80' could be pivotally secured to a portion of the chair frame in a manner that allows for pivotal motion of the back frame support 65 and maintains the substantial horizontal plane alignment with the seat member rear portions 90 and 95 when the back fram support 65 is in the non-reclined position.

Figure 6A:
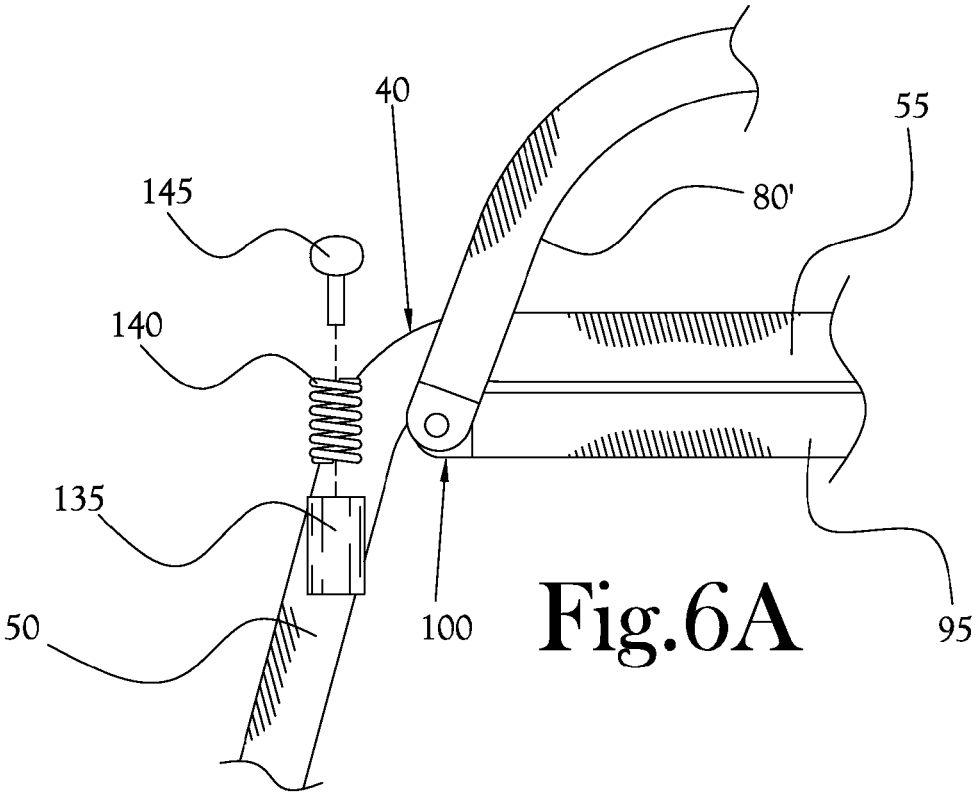
FIGS. 6A, 6B and 6C are partial elevation views showing the interaction of the back frame member and the spring assembly during assembly of the chair and during reclining of the back frame member.

In order to provide a back support frame 65 that repetitively reclines and rebounds to a generally vertical position relative to the seat assembly 15, the rear cross support member 25 includes distal ends 125 which are secured to the rear legs 50. A recess 130 is provided at each distal end 125. Further, at least one compression member 140 is carried by at least one distal end 125. In the preferred embodiment, a cylindrical can member 135 is carried by recess 130. The compression member 140 is received within the can member 135. Further, a plunger member 145 is received within the can member 135 and engages the compression member 140 such that the compression member biases the plunger 145 upward when the plunger 145 engages and compresses compression member 140. In this regard, the can 135 is positioned such that the lower surface of each lower end 75' and 80' of the back support frame member 65 engages the plunger 145. As a reclining force is applied to the back support frame member 65 by an occupant of the chair 10, the lower ends 75' and 80' compress the plunger 145 against the biasing force of the compression member 140. The can member 135 serves as a stop to limit the extent of reclining motion for the back support frame member. The fully reclined position is illustrated in FIG. 6C.

Figure 3A:
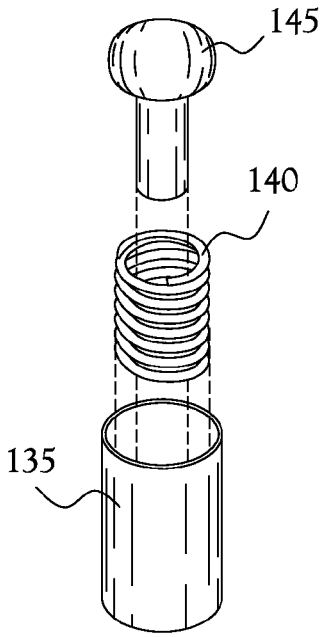
In FIGS. 3A and 3B, the compression member is illustrated as a helical coil spring.
Figure 3B:
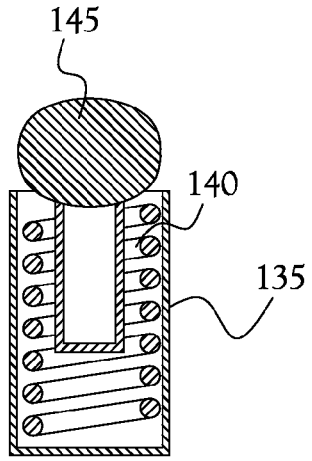
Figure 3C:
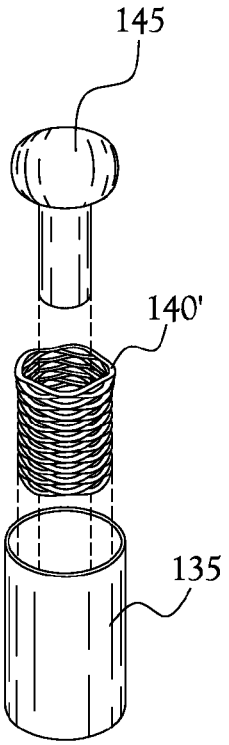
In FIG. 3C, the compression member is illustrated as a crest-to-crest wave spring.
Figure 6B:
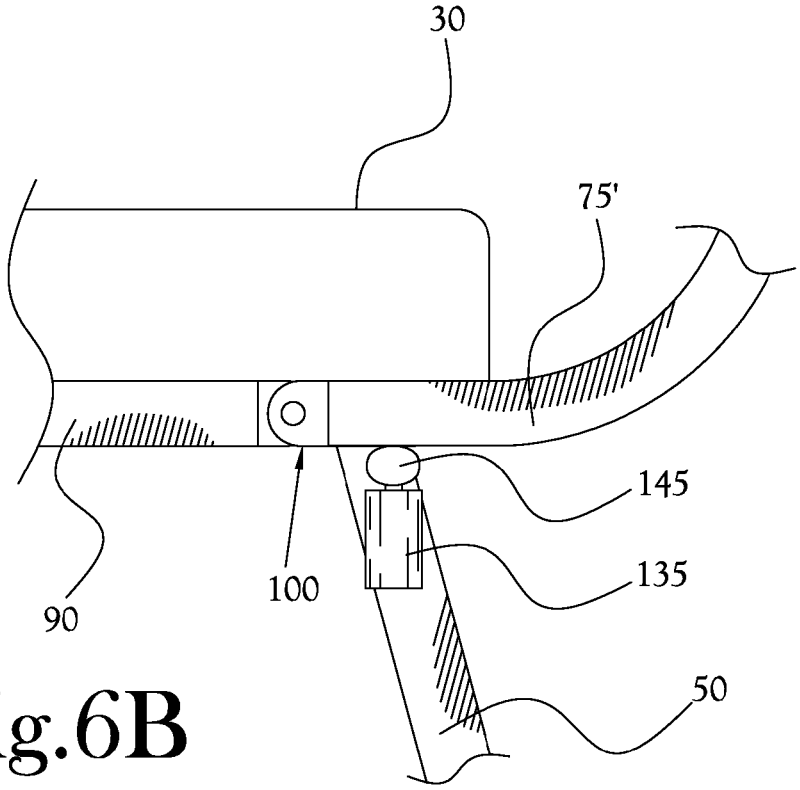
Figure 6C:
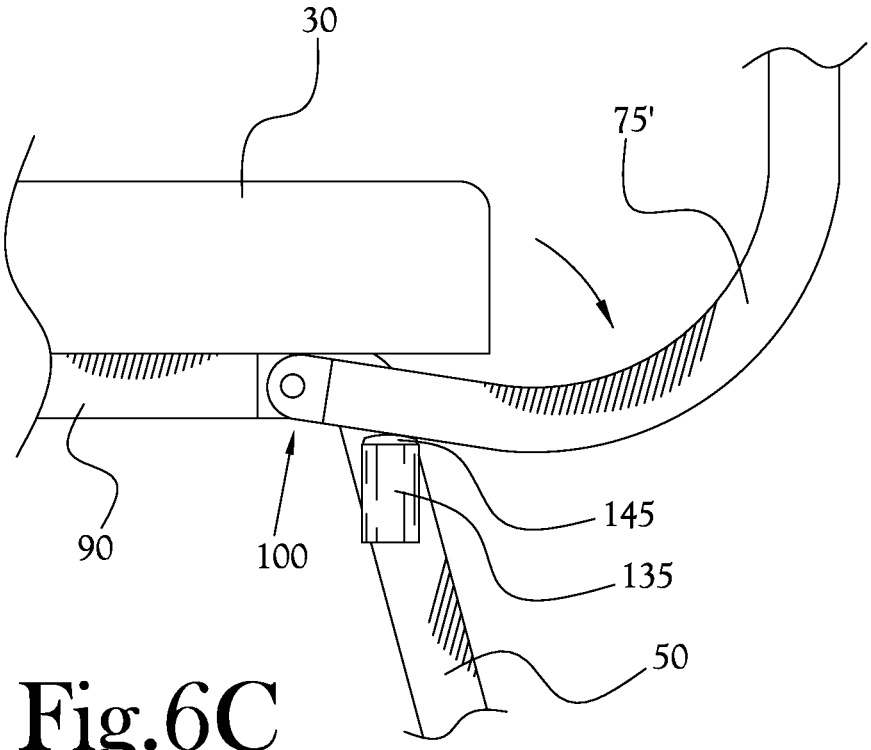
Figure 7:
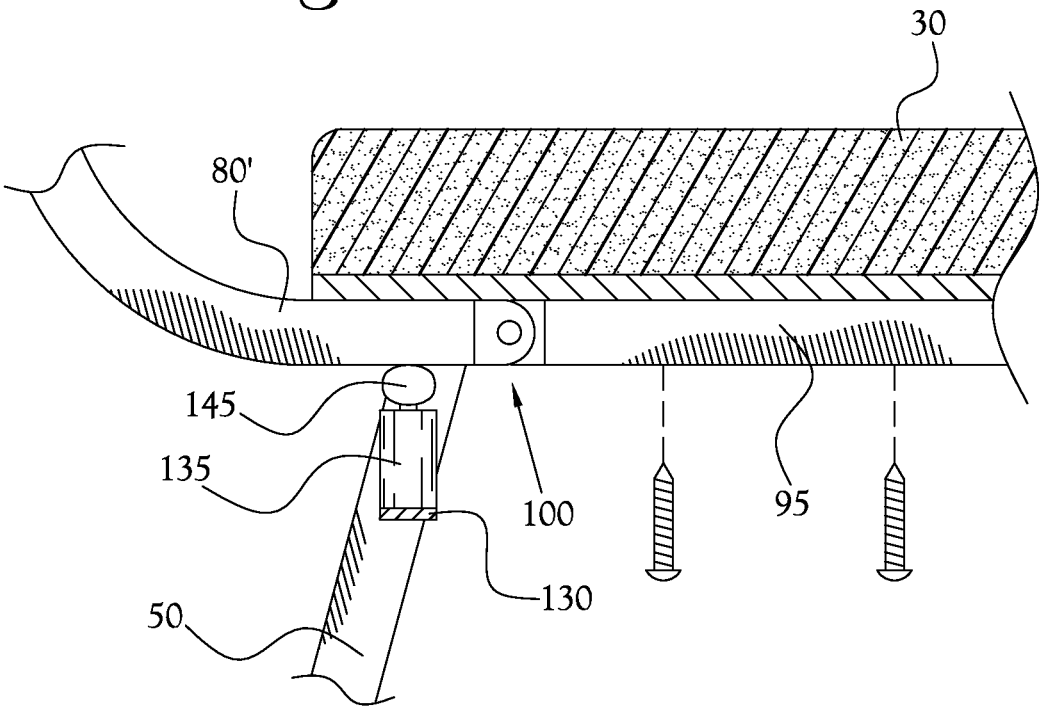
FIG. 7 is a side elevation view of the chair illustrated in FIG. 1 showing a seat cushion.

The compression member 140 of the improved spring can assembly biases the back frame support member 65 to return to the non-reclined position shown in FIG. 6B, after the reclining force is released. Whereas in one embodiment, illustrated in FIGS. 3A and 3B, compression member 140 is defined by a helical coil spring, it will be appreciated that other compression members could be utilized. For instance, as illustrated in FIG. 3C, compression member 140' could be defined by a crest-to-crest wave spring. Those skilled in the art will recognize that other known compression members could be utilized for biasing the plunger 145 upward upon release of the reclining pressure applied to the back support frame member 65. In the preferred embodiment, the range of compression of the plunger member 145 and compression member 140 is limited to approximately ⅜". Further, while the can member 135 is illustrated as being a separate component carried by recess 130, it will be appreciated that the can member 135 and the recess 130 could be integrally formed.

In one embodiment, as the chair 10 is being assembled, it will be appreciated that the frame members will be fully assembled prior to the attachment of either the seat cushion 30 or the supporting seat back member (not shown) are attached. With the back frame support member 65 tilted forward, as illustrated in FIG. 6A, compression member 140 and plunger member 145 are inserted within can 135. The back frame support member 65 is then returned to a neutral, i.e. non-reclined position. The seat cushion 30 is then secured to the seat support 15. The back portion of the seat cushion 30 extends over the frame lower ends 75' and 80'. In this position, the frame lower ends 75' and 80' will engage the lower surface of the seat cushion 30 if the back frame support member is flexed substantially forward, thereby retaining compression member 140 and plunger 145 within the can member 135. It will be appreciated by those skilled in the art that the spring can assembly of the present invention allows the compression member to be readily and easily changed, thus providing the ability to easily adjust the flex tension of the back support member.

While the present invention has been illustrated by description of some embodiments, and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A chair, comprising:

a seat assembly including right and left seat members having spaced apart rear portions and a rear cross support member, said rear cross support member having right and left distal ends;

a right and left pair of front and rear leg members supporting said seat assembly and joined outboard of respective seat members;

a back support, including spaced apart right and left side support members, said right and left side support members extending downwardly to respective right and left lower ends curved forwardly to be positioned in alignment with and spaced apart by right and left gap separations from respective seat member rear portions;

at least one hinge member for hingedly connecting at least one of said right and left lower ends with at least one of said respective seat member rear portions; and said right and left back support lower ends and said right and left seat member rear portions are hollow, wherein said at least one hinge member defines a talon which is adapted to be received within said hollow rear portions of said right and left back support lower ends and said right and left seat member rear portions; and at least one compression member carried by said distal end of said rear cross support member for being compressed by at least one said lower end of said back support, whereby said back support is reclined when sufficient force is applied against said back support to compress said at least one compression member, said back support being returned to a substantially upright position relative to said seat assembly by said at least one compression member biasing said back support member to return to a non-flexed position.

2. The chair of claim 1 wherein said chair is stackable.

3. The chair of claim 1 wherein said at least one compression member is received within a can member carried by said distal end of said rear cross support member, and further wherein a plunger member engages said at least one compression member, said plunger member also engaging a lower surface of said forwardly curved lower ends of said back support.

4. The chair of claim 3 wherein said can member is integral with and defined by a recess proximate said distal end of said rear cross support member.

5. The chair of claim 1 further comprising:

a seat cushion removably connected to be supported on said seat assembly, said seat cushion having a sufficient width to extend between said right and left seat members and having a sufficient length to cover said back support lower ends positioned in alignment with and spaced apart by said right and left gap separations from respective seat member rear portions, thereby limiting the forward motion of said back support relative to said seat assembly.

6. The chair of claim 1 wherein said at least one compression member defines a helical coil spring.

7. The chair of claim 1 wherein said at least one compression member defines a crest-to-crest wave spring.

8. A chair, comprising:

a seat assembly including right and left seat members having spaced apart rear portions and a rear cross support member, said rear cross support member having right and left distal ends, each said distal end defining a recess;

a right and left pair of front and rear leg members supporting said seat assembly and joined outboard of respective seat members;

a back support, including spaced apart right and left side support members, said right and left side support members extending downwardly to respective right and left lower ends curved forwardly to be positioned in alignment with and spaced apart by right and left gap separations from respective seat member rear portions;

first and second hinge members for hingedly connecting said right and left lower ends with said respective seat member rear portions; and a right and left spring can assembly carried by said respective recesses of said right and left distal ends of said rear cross support member, wherein said spring can assembly includes a can member, a compression member received within said can member, and a plunger member for engaging said compression member, said plunger member also engaging a lower surface of said forwardly curved lower ends of said back support;

whereby said back support is reclined when sufficient force is applied against said back support to pivot compress said compression member within said can member, said back support being returned to a substantially upright position relative to said seat assembly by each compression member biasing said back support member to return to a non-flexed position.

9. The chair of claim 8 wherein said chair is stackable.

10. The chair of claim 8 wherein said right and left back support lower ends and said right and left seat member rear portions are hollow, wherein said hinge members define talons which are adapted to be received within said hollow rear portions of said right and left back support lower ends and said right and left seat member rear portions.

11. The chair of claim 8, wherein said can member is integrally formed with said recess.

12. The chair of claim 8, further comprising:

a seat cushion removably connected to be supported on said seat assembly, said seat cushion having a sufficient width to extend between said right and left seat members and having a sufficient length to cover said back support lower ends positioned in alignment with and spaced apart by said right and left gap separations from respective seat member rear portions, thereby limiting the forward motion of said back support relative to said seat assembly.

13. The chair of claim 8 wherein said compression member defines a helical coil spring.

14. The chair of claim 8 wherein said compression member defines a crest-to-crest wave spring.

15. A stackable chair, comprising:

a seat assembly including right and left seat members having spaced apart rear portions and a rear cross support member, said rear cross support member having right and left distal ends, each said distal end defining a recess, said rear cross support member disposed in a substantially horizontal plane with said seat members;

a right and left pair of front and rear leg members supporting said seat assembly and joined outboard of respective seat members to facilitate stacking on a like-configured seat assembly;

a back support, including spaced apart right and left side support members, said right and left side support members extending downwardly to respective right and left lower ends curved forwardly to be positioned in alignment with and spaced apart by right and left gap separations from respective seat member rear portions;

first and second hinge members for hingedly connecting said right and left lower ends with said respective seat member rear portions;

a right and left spring can assembly carried by said respective recesses of said right and left distal ends of said rear cross support member, wherein said spring can assembly includes a can member, a compression member received within said can member, and a plunger member for engaging said compression member, said plunger member also engaging a lower surface of said forwardly curved lower ends of said back support;

whereby said back support is reclined when sufficient force is applied against said back support to pivot compress said compression member within said can member, said back support being returned to a substantially upright position relative to said seat assembly by each compression member biasing said back support member to return to a non-flexed position; and a seat cushion removably connected to be supported on said seat assembly, said seat cushion having a sufficient width to extend between said right and left seat members and having a sufficient length to cover said back support lower ends positioned in alignment with and spaced apart by said right and left gap separations from respective seat member rear portions, thereby limiting the forward motion of said back support relative to said seat assembly.

16. The chair of claim 15 wherein said right and left back support lower ends and said right and left seat member rear portions are hollow, wherein said hinge members define talons which are adapted to be received within said hollow rear portions of said right and left back support lower ends and said right and left seat member rear portions.

17. The chair of claim 15 wherein said can member is integrally formed with said recess.

18. The chair of claim 15 wherein said compression member defines a helical coil spring.

19. The chair of claim 15 wherein said compression member defines a crest-to-crest wave spring.

* * * * *